US010337277B2

(12) United States Patent
van Wijk et al.

(10) Patent No.: US 10,337,277 B2
(45) Date of Patent: Jul. 2, 2019

(54) CLOSED-LOOP SOLENOID SYSTEM

(71) Applicant: Cameron International Corporation, Houston, TX (US)

(72) Inventors: Johannes van Wijk, GS Rijswijk (NL); Edward C. Gaude, Houston, TX (US)

(73) Assignee: Cameron International Corporation, Houston, TX (US)

( * ) Notice: Subject to any disclaimer, the term of this patent is extended or adjusted under 35 U.S.C. 154(b) by 158 days.

(21) Appl. No.: 14/946,326

(22) Filed: Nov. 19, 2015

(65) Prior Publication Data

US 2017/0145773 A1 May 25, 2017

(51) Int. Cl.

| | |
|---|---|
| ***E21B 33/035*** | (2006.01) |
| ***E21B 33/064*** | (2006.01) |
| ***E21B 34/16*** | (2006.01) |
| ***F15B 1/02*** | (2006.01) |

(52) U.S. Cl.

CPC ..... *E21B 33/064* (2013.01); *E21B 33/0355* (2013.01); *E21B 34/16* (2013.01); *F15B 1/02* (2013.01)

(58) Field of Classification Search

CPC .... E21B 33/0355; E21B 33/064; E21B 34/16; F15B 1/02

See application file for complete search history.

(56) References Cited

U.S. PATENT DOCUMENTS

| | | | | |
|---|---|---|---|---|
| 3,405,387 | A * | 10/1968 | Koomey | E21B 33/0355 166/368 |
| 3,743,013 | A * | 7/1973 | Harbonn | F15B 1/02 166/368 |
| 6,192,680 | B1 * | 2/2001 | Brugman | E21B 33/0355 60/398 |
| 7,107,766 | B2 * | 9/2006 | Zacche' | A23L 3/0155 60/413 |
| 8,322,427 | B2 * | 12/2012 | Inderberg | E21B 47/1025 166/250.01 |
| 8,387,706 | B2 * | 3/2013 | Baugh | E21B 33/038 166/339 |
| 8,727,018 | B1 * | 5/2014 | McCulloch | E21B 33/0355 166/375 |
| 9,033,049 | B2 * | 5/2015 | Kotrla | E21B 33/0355 166/338 |
| 9,175,538 | B2 * | 11/2015 | Wordley | E21B 33/0355 |
| 9,234,400 | B2 * | 1/2016 | Warnock, Jr. | E21B 33/0355 |
| 9,657,553 | B2 * | 5/2017 | Ottestad | E21B 41/0007 |
| 2013/0074687 | A1 * | 3/2013 | Nellessen | F15B 1/02 92/142 |

(Continued)

*Primary Examiner* — Matthew R Buck
(74) *Attorney, Agent, or Firm* — Helene Raybaud

(57) ABSTRACT

An apparatus for controlling hydraulically actuatable components of a blowout preventer stack assembly and a system for same. The apparatus comprises a blowout preventer stack including hydraulically actuatable components and a lower marine riser package coupled to the blowout preventer stack and including additional hydraulic components. The lower marine riser package includes a solenoid valve configured to control at least some of the components. The solenoid valve receives hydraulic fluid from a dedicated accumulator or accumulator bank configured to supply hydraulic fluid exclusively for use with the solenoid valve. A closed-loop hydraulic circuit is formed between the accumulator or accumulator bank and the solenoid valve.

20 Claims, 6 Drawing Sheets

(56) References Cited

U.S. PATENT DOCUMENTS

| | | | | |
|---|---|---|---|---|
| 2013/0175045 | A1* | 7/2013 | Rytlewski | E21B 33/0355 166/363 |
| 2015/0308212 | A1* | 10/2015 | Maunus | F15B 1/022 166/368 |
| 2017/0102085 | A1* | 4/2017 | Smith, III | E21B 33/038 |

* cited by examiner

CLOSED-LOOP SOLENOID SYSTEM

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly through which the resource is accessed or extracted. These wellhead assemblies may include a wide variety of components, such as various casings, valves, fluid conduits, and the like, that control drilling or extraction operations. Subsea wellhead assemblies typically include control pods that operate hydraulic components and manage flow through the assemblies.

This invention relates to a closed-loop solenoid pressure supply system for operating subsea hydraulically-actuatable devices such as valves, blowout preventers and hydraulically actuated wellhead connectors. Such devices require pressurized hydraulic fluid, typically operated up to 5,000 psi, for their operation. The disclosed closed-loop solenoid pressure supply system is used in the control of the flow of such pressurized hydraulic fluid.

Subsea hydraulic control systems typically consist of a group of hydraulic fluid accumulators, a control unit for operating solenoid valves which control hydraulic fluid supply, and high pressure lines or hoses which carry the hydraulic control fluid from the accumulator bottles to the control unit and on to the component to be operated, e.g., valve, blowout preventer, wellhead connector, and the like. Pressurized hydraulic control fluid is stored in the accumulator bottles at a desired operating pressure, e.g., 1500, 3000 psi, 4,500 psi. This hydraulic fluid is used throughout the subsea system. Typically, hydraulic fluid used in a control system is a mixture of mostly water and a concentrate fluid that provides lubricity and corrosion protection for proper operation of the valves in the system. Frequently, the control fluid is not properly maintained and will become contaminated due to bacteria growing in the system or lack of maintenance. It is widely accepted in the industry that fluid contamination is a wide spread problem that can lead to considerable non-productive time and, accordingly, lost revenue.

Solenoid valves disposed in the control pod are particularly susceptible to hydraulic fluid contamination. Because existing subsea systems use the same hydraulic fluid throughout the system, contamination of the hydraulic fluid exposes all components, including solenoid valves, to the contamination. Accordingly, it is desirable to have a control system with reduced contamination of solenoid valves disposed therein. The present invention relates to a closed-loop solenoid valve pressure supply system, wherein the solenoid valves have their own dedicated hydraulic fluid supply separate from the hydraulic fluid used for the rest of the system, i.e., the main hydraulic fluid supply. Because the solenoid valves have their own dedicated fluid supply in a closed-loop system, the fluid can be a high quality fluid that will not degrade over time and can be filtered to a high degree to protect the solenoid valves. By reducing contamination and increasing fluid quality, the life of each solenoid valve can be greatly extended.

BRIEF DESCRIPTION OF THE DRAWINGS

Illustrative embodiments of the present disclosure are described in detail below with reference to the attached drawing figures, which are incorporated by reference herein and wherein.

Figure 1:
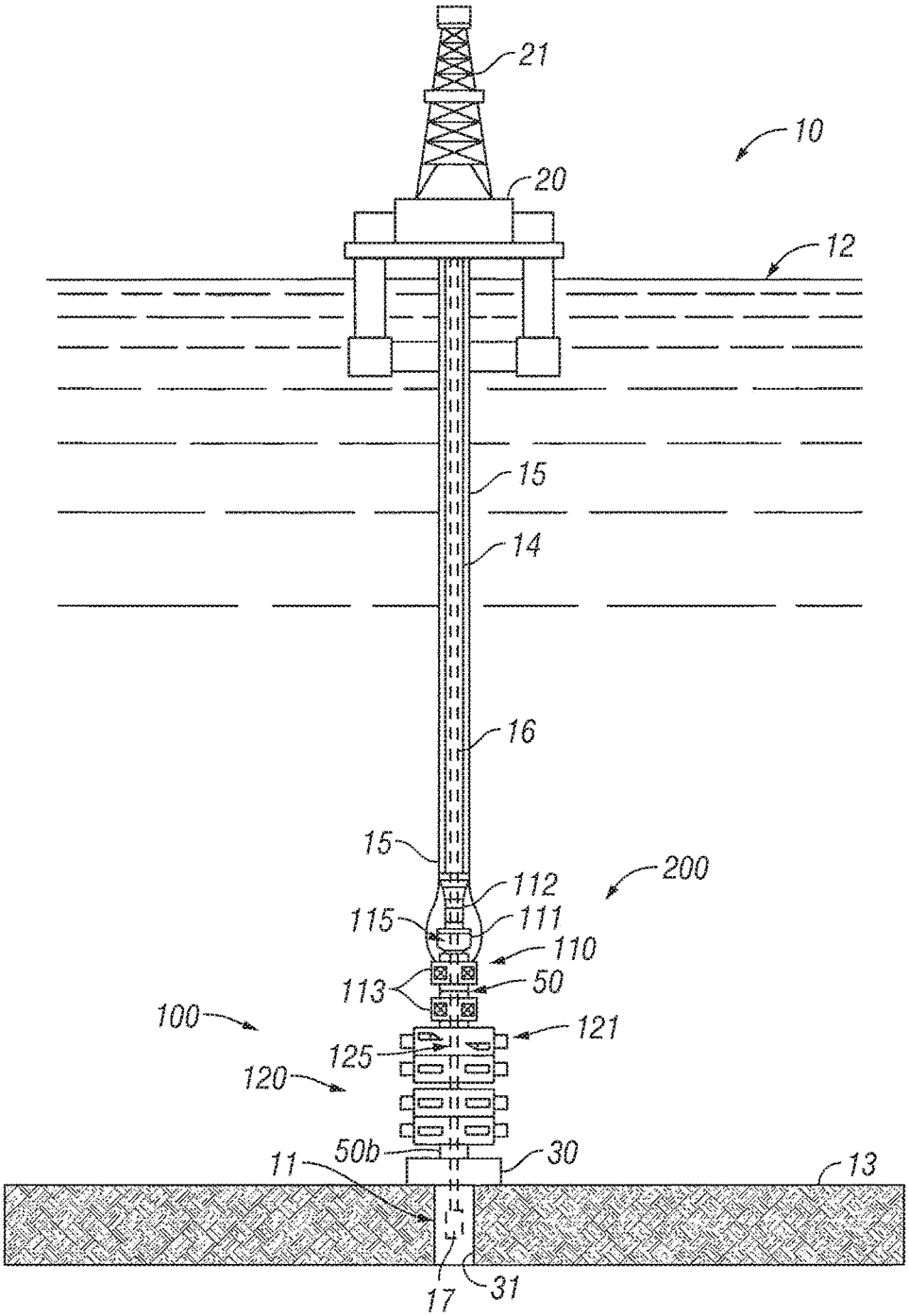
FIG. 1 is a schematic view of an embodiment of an offshore system for drilling and/or producing a subterranean wellbore.

The illustrated figures are only exemplary and are not intended to assert or imply any limitation with regard to the environment, architecture, design, or process in which different embodiments may be implemented.

DETAILED DESCRIPTION

The following discussion is directed to various embodiments of the present disclosure. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Referring now to FIG. 1, an embodiment of an offshore system 10 for drilling and/or producing a wellbore 11 is shown. In this embodiment, system 10 includes an offshore vessel or platform 20 at the sea surface 12 and a subsea BOP stack assembly 100 mounted to a wellhead 30 at the sea floor 13. Platform 20 is equipped with a derrick 21 that supports a hoist (not shown). A tubular drilling riser 14 extends from platform 20 to BOP stack assembly 100. Riser 14 returns drilling fluid or mud to platform 20 during drilling operations. One or more hydraulic conduit(s) 15 extend along the outside of riser 14 from platform 20 to BOP stack assembly 100. Conduit(s) 15 supply pressurized hydraulic fluid to assembly 100. Casing 31 extends from wellhead 30 into subterranean wellbore 11.

Downhole operations are carried out by a tubular string 16 (e.g., drill string, production tubing string, coiled tubing, etc.) that is supported by derrick 21 and extends from platform 20 through riser 14, through the BOP stack assembly 100, and into the wellbore 11. A downhole tool 17 is connected to the lower end of tubular string 16. In general, downhole tool 17 may comprise any suitable downhole tool(s) for drilling, completing, evaluating and/or producing wellbore 11 including, without limitation, drill bits, packers, cementing tools, casing or tubing running tools, testing equipment, perforating guns, and the like. During downhole operations, string 16, and hence tool 17 coupled thereto, may move axially, radially, and/or rotationally relative to riser 14 and BOP stack assembly 100.

Figure 2:
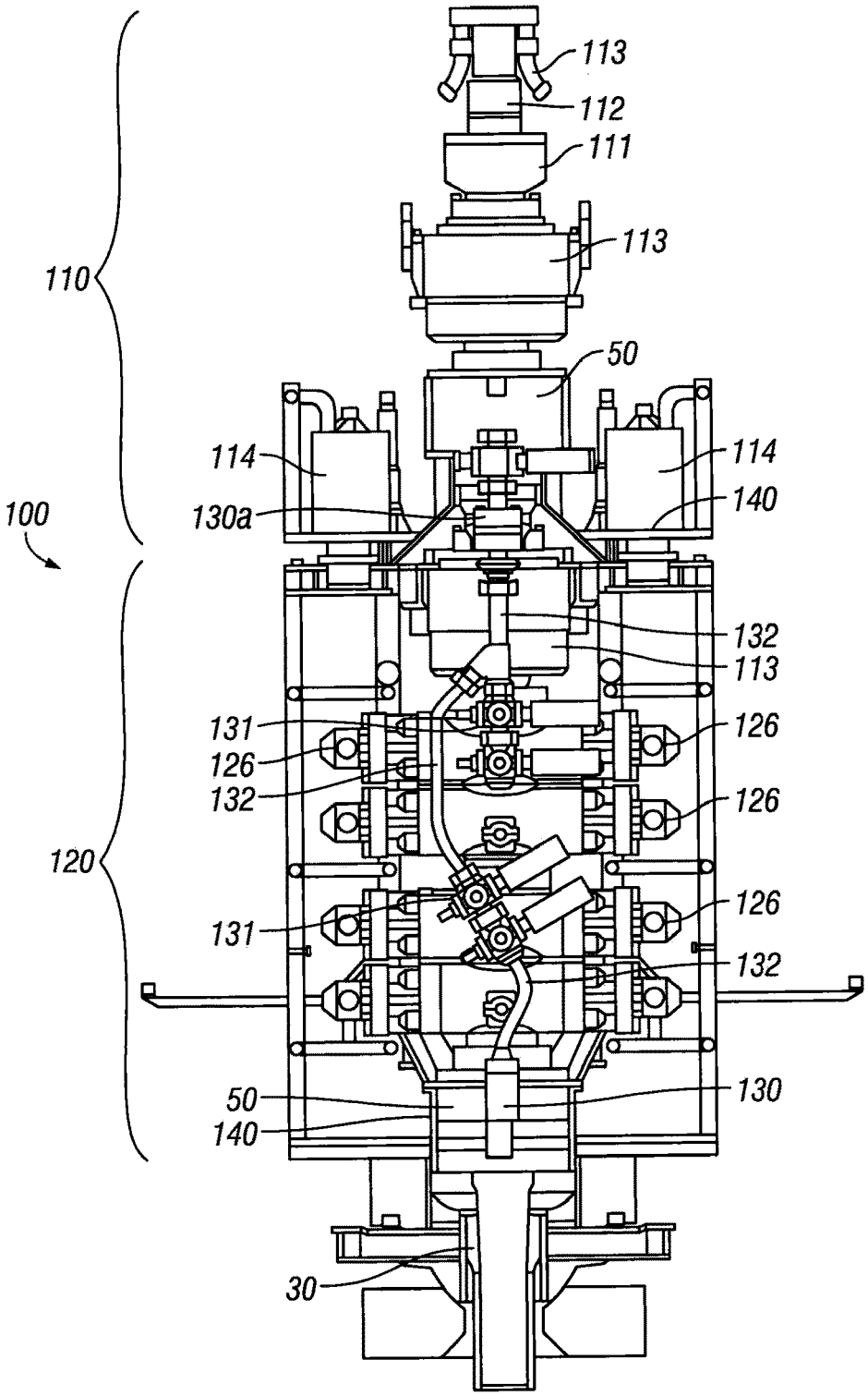
FIG. 2 is an elevation view of an embodiment of the subsea blowout preventer ("BOP") stack assembly of FIG. 1.
Figure 3:
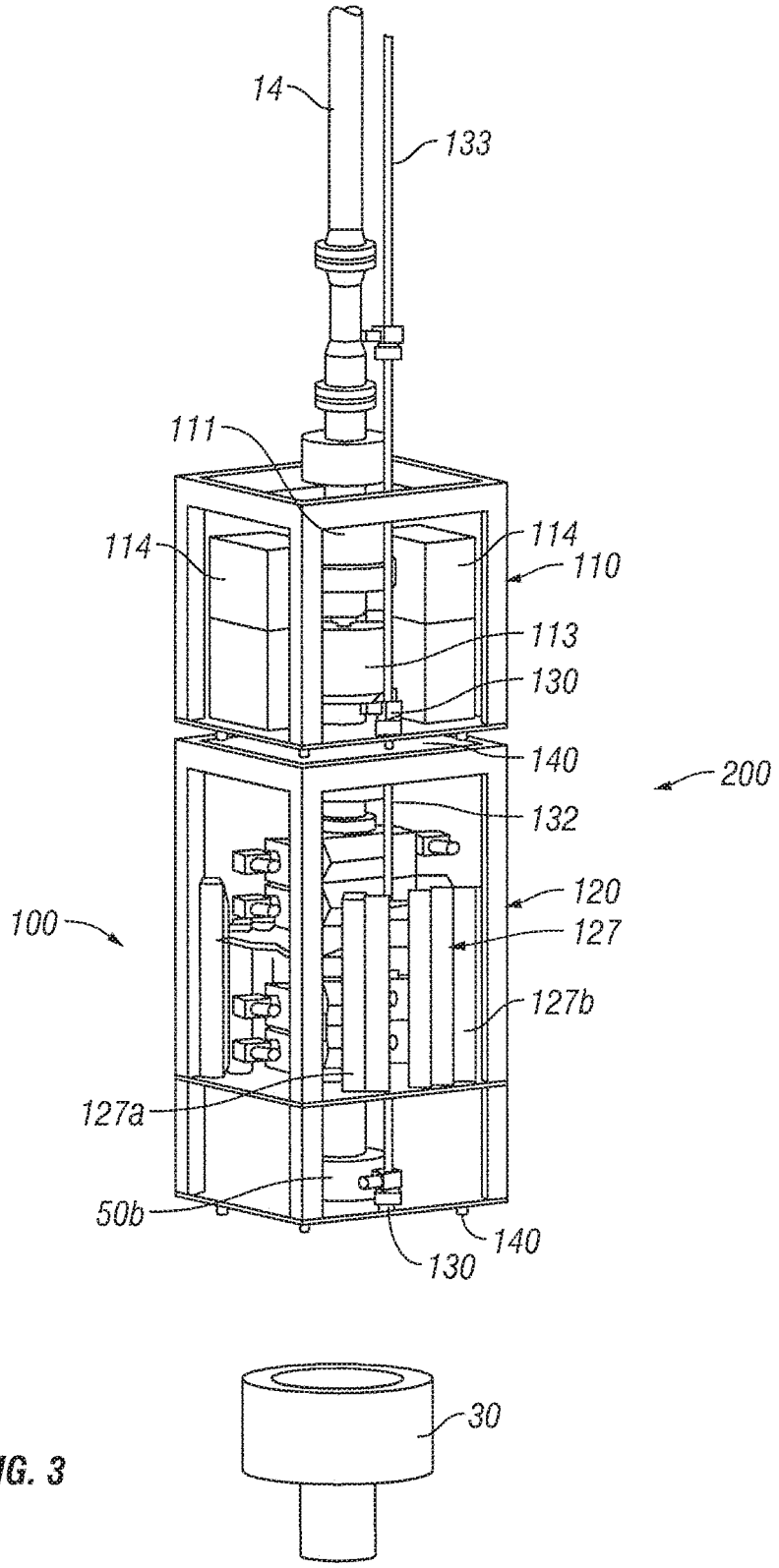
FIG. 3 is a perspective exploded view of the subsea BOP stack assembly of FIGS. 1 and 2.

Referring now to FIGS. 1-3, BOP stack assembly 100 is mounted to wellhead 30 and is designed and configured to control and seal wellbore 11, thereby containing the hydrocarbon fluids (liquids and gases) therein. In this embodiment, BOP stack assembly 100 comprises a lower marine riser package ("LMRP") 110, and BOP stack 120. BOP stack 120 is releasably secured to wellhead 30 and to LMRP 110 which is releasably secured to riser 14. The connections between wellhead 30, BOP stack 120, and LMRP 110 comprises hydraulically actuated, mechanical wellhead-type connections 50.

In general, connections 50 may comprise any suitable releasable wellhead-type mechanical connection such as the DWHC or HC profile subsea wellhead system available from Cameron International Corporation of Houston, Tex., or any other such wellhead profile available from several subsea wellhead manufacturers. Typically, such hydraulically actuated, mechanical wellhead-type connections (e.g., connections 50) comprise an upward-facing male connector or "hub," labeled with reference numeral 50 *a* herein, that is received by and releasably engages a downward-facing mating female connector or receptacle, labeled with reference numeral 50 *b* herein. In this embodiment, the connection between LMRP 110 and riser 14 is a flange connection that is not remotely controlled, whereas connections 50 may be remotely, hydraulically controlled.

Referring still to FIGS. 1-3, LMRP 110 comprises a riser flex joint 111, a riser adapter 112, an annular BOP 113, and a pair of redundant control units or pods 114. Although two control pods 114 are shown in the illustrated embodiment, any number of control pods suitable for controlling devices can be installed. A flow bore 115 extends through LMRP 110 from riser 14 at the upper end of LMRP 110 to connection 50 at the lower end of LMRP 110. Riser adapter 112 extends upward from flex joint 111 and is coupled to the lower end of riser 14. Flex joint 111 allows riser adapter 112 and riser 14 connected thereto to deflect angularly relative to LMRP 110 while wellbore fluids flow from wellbore 11 through BOP stack assembly 100 into riser 14. Annular BOP 113 comprises an annular elastomeric sealing element that is mechanically squeezed radially inward to seal on a tubular extending through LMRP 110 (e.g., string 16, casing, drill pipe, drill collar, etc.) or seal off bore 115. Thus, annular BOP 113 has the ability to seal on a variety of pipe sizes and/or profiles, as well as perform a "Complete Shut-off" to seal bore 115 when no tubular is extending therethrough.

As best shown in FIG. 3, BOP stack 120 also includes a set or bank 127 of hydraulic accumulators mounted on BOP stack 120. While the primary hydraulic pressure supply is provided by hydraulic conduits 15 extending along riser 14 from a surface hydraulic fluid supply source, the accumulator bank 127 may be used to support operation of BOP stack 120 rams 121 (i.e., supply hydraulic pressure to actuators 126 that drive rams 121 of BOP stack 120), choke/kill valves 131, connector 50*b* of BOP stack 120, and choke/kill connectors 130 of BOP stack 120. Accumulator bank 127 serves as a backup means to provide hydraulic power to operate rams 121 valves 131, connector 50*b*, and connectors 130 of BOP stack 120. Upon demand, pressurized hydraulic fluid from the bank of accumulators 127 can be delivered to a device to be operated (e.g., valve, connector, BOP ram) by actuating one or more valves disposed on the control pod 114. Control pods 114 are connected to the devices to be operated by suitable conduits, such as control tubing or hoses. This allows the control pods 114 to route hydraulic control fluid to the device to cause the device to perform its intended function, such as closing the rams of a blowout preventer or opening a valve.

Figure 4:
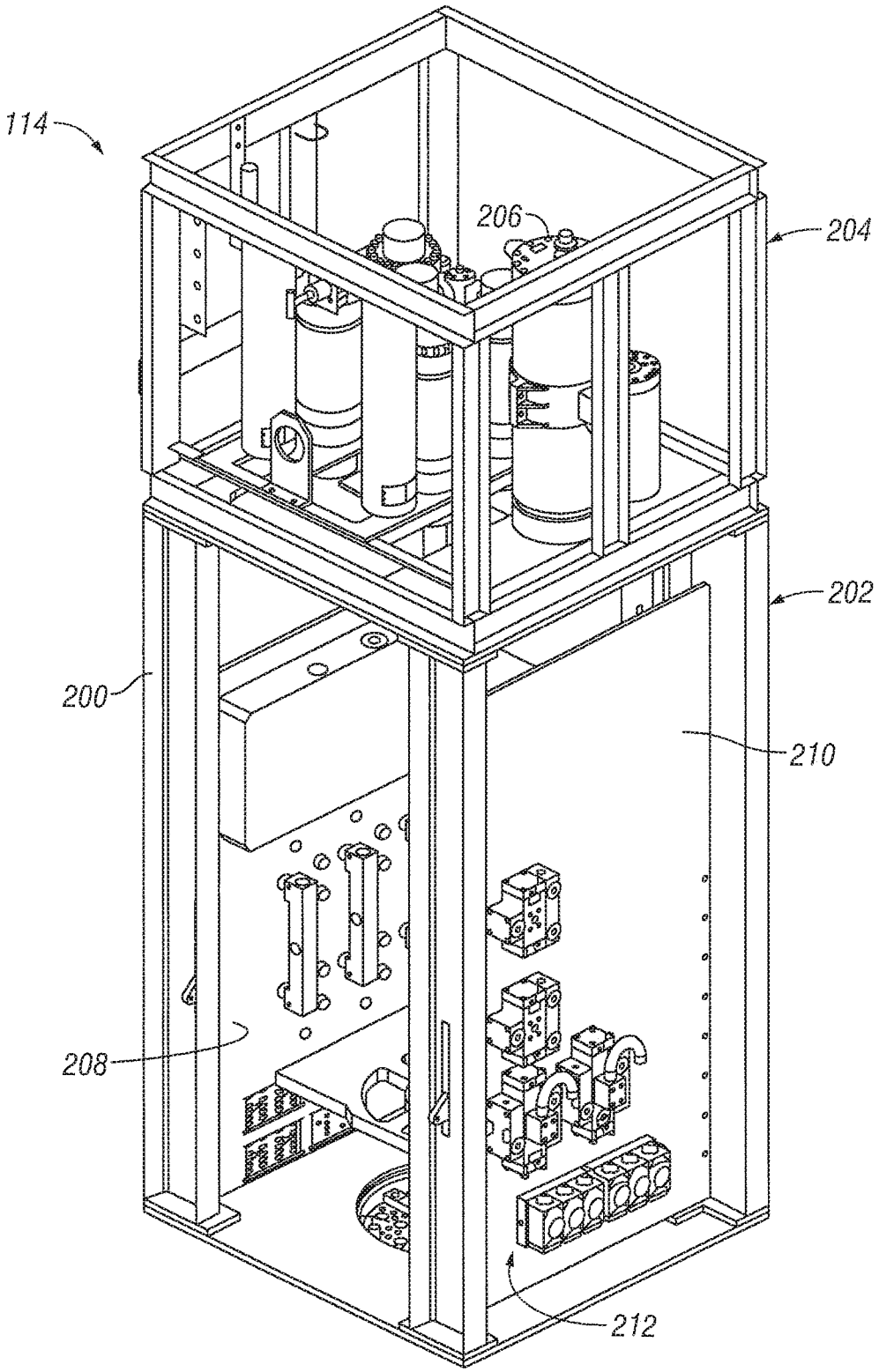
FIG. 4 is a front perspective view of one control pod of the BOP stack assembly of FIGS. 1-3.
Figure 5:
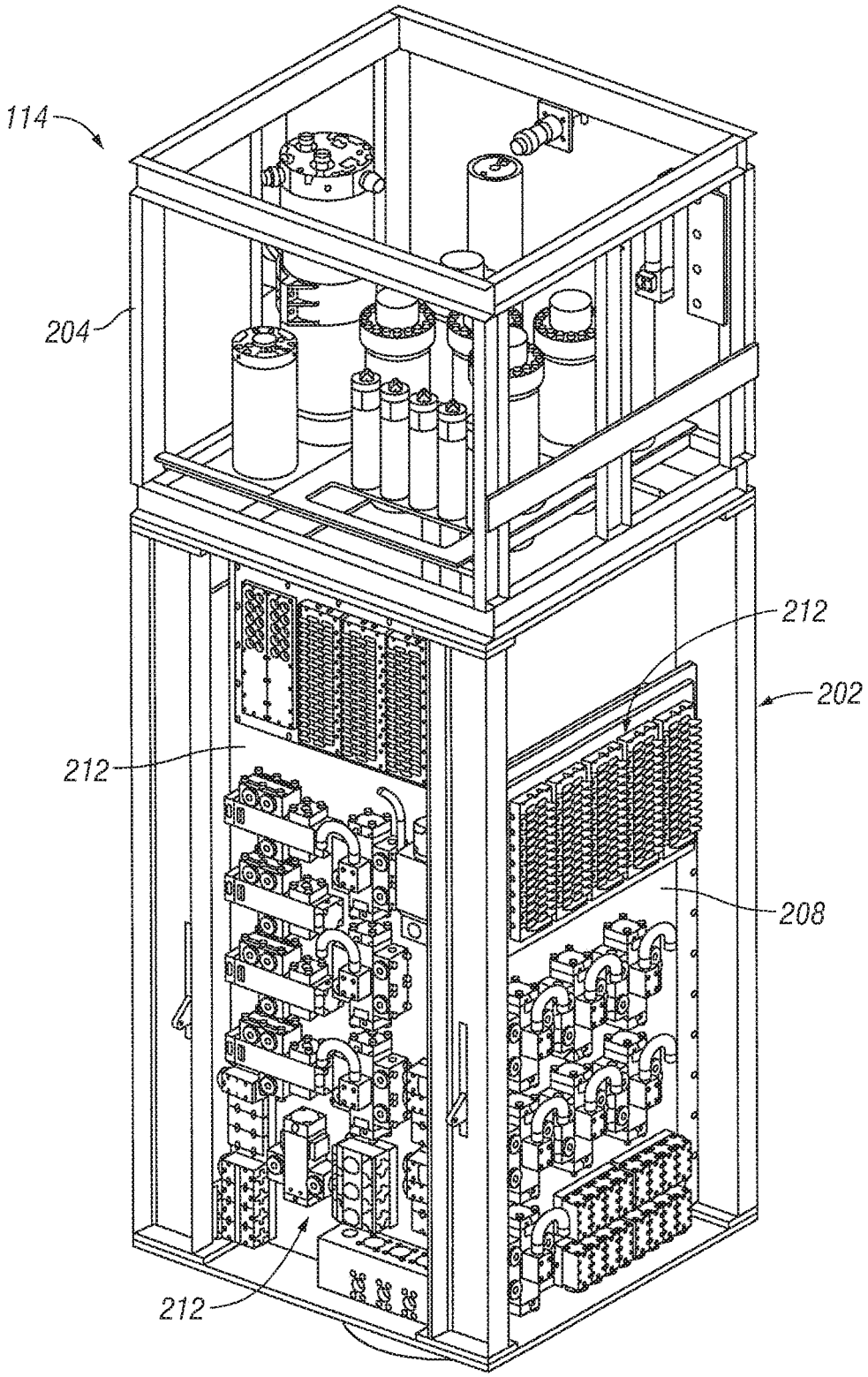
FIG. 5 is a rear perspective view of the control pod of FIG. 4.

An example of one of the control pods 114 installed on the lower marine riser package 110 of FIGS. 1-3 is depicted in greater detail in FIGS. 4 and 5. The control pod 114 includes a frame 200 with a lower section 202 and an upper section 204. The lower section 202 includes numerous valves, including solenoid valves, for controlling flow of hydraulic control fluid to hydraulically actuatable components of the wellhead assembly, and the upper section 204 (which may also be referred to as a multiplexing section) includes a subsea electronics module 206 that controls operation of the valves of section 202 based on received command signals. The command signals may originate from the surface or subsea. In the depicted embodiment, the lower section 202 includes panels or sub-plates 208 and 210 having sub-plate mounted solenoid valves 212.

The accumulator bank 127 includes main system accumulators 127*a* and solenoid accumulators 127*b*. The main system accumulators 127*a* contain a biodegradable hydraulic fluid comprising a mixture of water and additives for providing lubricity and corrosion protection, such as oil, and ethylene glycol. The biodegradable hydraulic fluid mixture can be safely discharged into the external subsea environment surrounding the control pod 114. The main system accumulators 127*a* provide hydraulic fluid for all components of the subsea offshore system 10 other than the solenoid valves 212. The solenoid valves 212 are in fluid communication with solenoid accumulators 127*b*. The solenoid accumulators 127*b* are dedicated solely to the solenoid valves 212 and contain a high-quality, non-biodegradable hydraulic fluid comprising an oil mixture. The fluid supplied by the solenoid accumulators 127*b* to the solenoid valves 212 is used to operate functions of hydraulically actuatable equipment, such as valves, blowout preventers and wellhead connectors. After use, the fluid is vented from the solenoid valves 212. Unlike traditional systems in which the fluid is vented to the external subsea environment, the present system captures the vented fluid and returns it to the subsea accumulators 127*b*. By using a high-quality fluid in a closed-loop system, the fluid does not degrade over time and there is minimal contamination of the fluid. Accordingly, there is significantly reduced solenoid valve wear, resulting in extended solenoid valve life.

Figure 6:
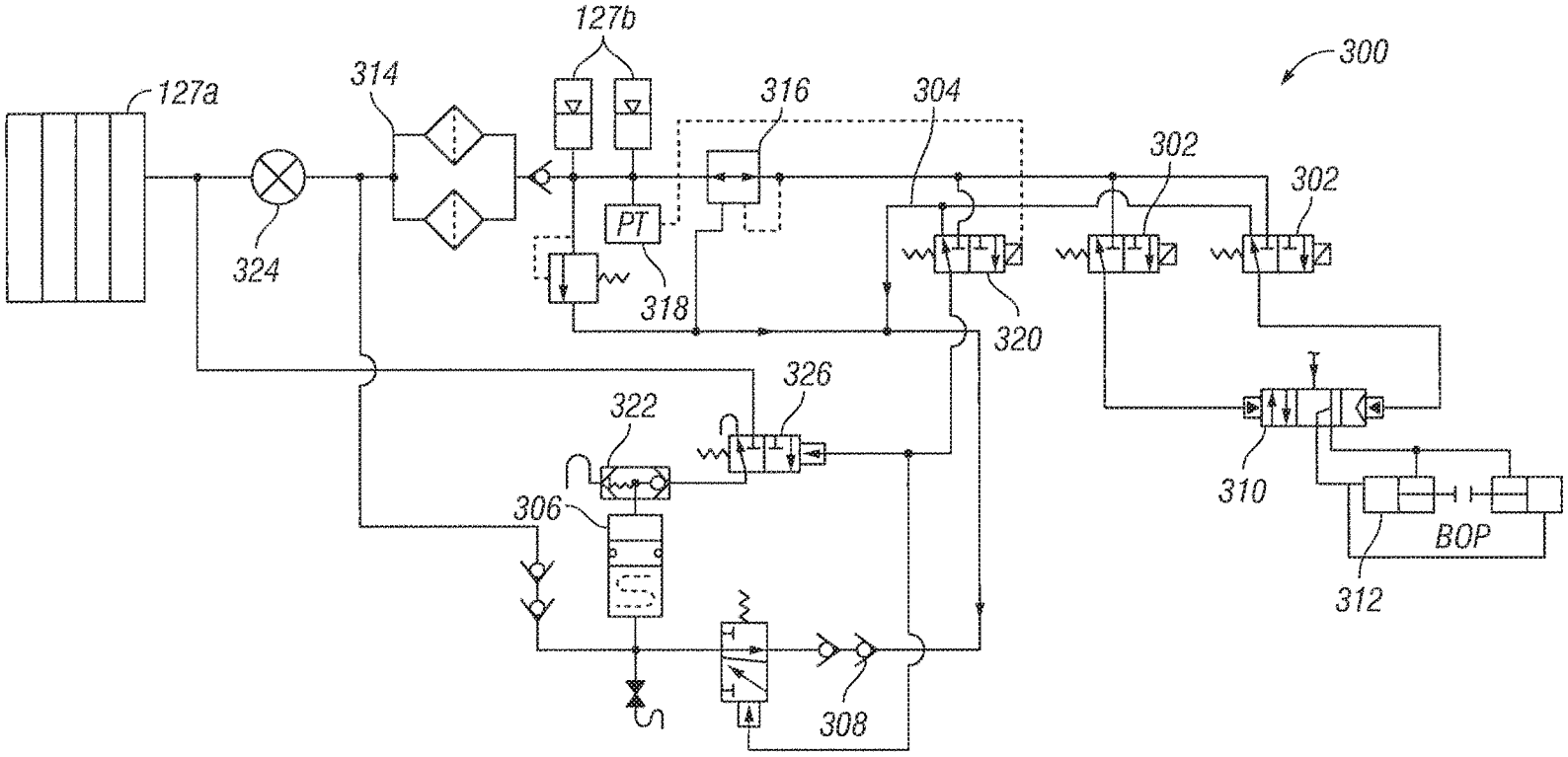
FIG. 6 is a schematic illustration of a closed-loop solenoid pressure supply system.

FIG. 6 is a schematic illustration of closed-loop system 300 which can be disposed on, e.g., an LMRP. The system comprises accumulators 127*b* which, as discussed above, are dedicated to solenoid valves 302. In the illustrated embodiment, two solenoid valves 302 are shown for illustrative purposes. However, it is commonly known in the art that one hundred or more solenoid valves may be disposed on a control pod. The solenoid valves 212 are preferably 3-way, 2-position valves. In the absence of an electronic or hydraulic control signal (i.e., the fail safe position), the valves are closed to hydraulic fluid, while providing the fluid communication of a downstream device with a pressure vent.

The solenoid valves 302 operate a function solenoid valve 310 which, in turn, operates a BOP stack 312. Although shown as operating a BOP stack assembly, the solenoid valves could be used to operate any hydraulically actuatable devices, such as valves and wellhead connectors.

Upon operation of the solenoid valves 302, a vent return line 304 captures hydraulic fluid vented from the solenoid valves 302 and transports the vented fluid to a reservoir transfer vessel 306. The reservoir transfer vessel is sized for the maximum storage volume of the accumulators 127*b*, plus additional capacity. For instance, maximum storage volume of the accumulators 127*b*, plus one gallon. The vent return line 304 contains multiple check vales to ensure that captured hydraulic fluid moves only in one direction and does not return to the solenoid valves 302.

The reservoir transfer vessel 306 stores used hydraulic fluid and can serve to re-pressurize the system in the event of pressure losses. From the reservoir transfer vessel, the hydraulic fluid passes to a filtration assembly 314 where the hydraulic fluid can be filtered to remove contaminants, if any. The hydraulic fluid is then returned to accumulators 127*b* where the fluid can be used again by the solenoid valves 302 to operate the function valve 310 and blowout preventer. The system further includes a pressure regulator 316 which regulates pressure in the system. The system also includes a pressure transducer 318. The pressure transducer is configured to trigger a reset valve 320 in the event that the pressure in accumulators 127*b* drops below a desired pressure. Opening of valve 320 triggers the reset valve 326, which activate a shuttle valve 322 and re-pressurizes the accumulators 127*b* by applying pressure to vessel 306. After release of the opening pressure on valve 326, the pressure in the line to vessel 306 is vented at valve 326 and shuttle valve 322.

The system 300 is a self-contained, closed loop system. However, the system includes a means for connecting the solenoid valves 212 to the main system accumulators 127*a*. In this case, the means includes valve 324 which can be opened in the event that the closed-loop system 300 experiences partial or complete failure. Valve 324 can be operated by a remotely operated vehicle. By opening valve 324, hydraulic fluid can be supplied from the main system accumulators 127*a* to the solenoid valves 212. As discussed above, this hydraulic fluid is lower quality, biodegradable hydraulic fluid. However, this fluid suffices in the event the closed-loop system 300 goes down.

The closed-loop system 300 may be included in a control pod coupled to an LMRP. Alternatively, the closed-loop system 300 can be retrofitted to existing control pods. To retrofit an existing assembly, the reservoir transfer vessel 306, shuttle valve 322, relief valve 326, and vent return line 304 would need to be installed on the existing assembly. The system 300 installable and retrievable by a remotely operated vehicle. Installation of these components would allow for conversion to a closed-loop system wherein higher quality hydraulic fluid can be used.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

We claim:

1. A system for controlling hydraulically actuatable components disposed on a subsea blowout preventer assembly, the system comprising:

a solenoid valve configured to control a flow of hydraulic fluid to adjust at least one of the hydraulically actuatable components;

a dedicated accumulator configured to supply the hydraulic fluid exclusively for use with the solenoid valve; and a reservoir transfer vessel comprising a first chamber configured to receive and store a portion of the hydraulic fluid and a second chamber configured to receive a second fluid to cause the portion of the hydraulic fluid in the first chamber to flow to the accumulator to re-pressurize the accumulator in the event of a pressure loss;

wherein a flow path of the hydraulic fluid flowing between the solenoid valve, the reservoir transfer vessel and the accumulator forms a closed loop.

2. The system of claim 1, further comprising a plurality of solenoid valves configured to control the flow of the hydraulic fluid to adjust the hydraulically actuatable components of the subsea blowout preventer assembly.

3. The system of claim 1, further comprising a plurality of dedicated accumulators configured to supply the hydraulic fluid exclusively for use with the solenoid valve.

4. The system of claim 1, further comprising a pressure transducer configured to monitor accumulator pressure, wherein the accumulator is configured to be re-pressurized by the reservoir transfer vessel if accumulator pressure drops below a selected pressure.

5. The system of claim 1, further comprising a second accumulator and a valve for fluidly coupling the solenoid valve to the second accumulator, wherein the second accumulator comprises a biodegradable hydraulic fluid, wherein the second accumulator is not configured to supply the biodegradable hydraulic fluid exclusively for use with the solenoid valve, and wherein the valve is operable by a remotely operated vehicle.

6. The system of claim 1, wherein the system is installable on an existing subsea blowout preventer assembly, and wherein the system is installable by a remotely operated vehicle.

7. The system of claim 1, wherein the hydraulically actuatable components include at least one of a valve, a ram, and a connector.

8. The system of claim 4, comprising a reset valve communicatively coupled to the pressure transducer, wherein the reset valve is configured to adjust to an open position when the accumulator pressure falls below the selected pressure.

9. The blowout preventer system of claim 8, wherein the hydraulic fluid flowing through the reset valve in the open position is configured to open a valve that fluidly couples a source of the second fluid with the second chamber of the reservoir transfer vessel to cause the portion of the hydraulic fluid in the first chamber to flow to the accumulator to re-pressurize the accumulator.

10. A subsea blowout preventer system comprising:

a subsea blowout preventer stack including hydraulically actuatable components; and a lower marine riser package coupleable to the subsea blowout preventer stack and comprising additional components, the lower marine riser package also comprising:

a solenoid valve configured to control a flow of hydraulic fluid to adjust at least one of the hydraulically actuatable components of the subsea blowout preventer stack and the additional components of the lower marine riser package;

an accumulator configured to supply the hydraulic fluid for use with the solenoid valve; and a reservoir transfer vessel comprising a first chamber configured to receive and store a portion of the hydraulic fluid and a second chamber configured to receive a second fluid to cause the portion of the hydraulic fluid in the first chamber to flow to the accumulator to re-pressurize the accumulator in the event of a pressure loss;

wherein a flow path of the hydraulic fluid flowing between the solenoid valve, the reservoir transfer vessel and the accumulator forms a closed loop.

11. The blowout preventer system of claim 10, further comprising a plurality of solenoid valves configured to control the flow of the hydraulic fluid to adjust the hydraulically actuatable components of the blowout preventer stack and the additional components of the lower marine riser package.

12. The blowout preventer system of claim 10, further comprising a plurality of accumulators configured to supply the hydraulic fluid exclusively for use with the solenoid valve.

13. The blowout preventer system of claim 10, further comprising a pressure transducer configured to monitor accumulator pressure, wherein the accumulator is configured to be re-pressurized by the reservoir transfer vessel if accumulator pressure drops below a selected pressure.

14. The blowout preventer system of claim 10, further comprising a second accumulator and a valve for fluidly coupling the solenoid valve to the second accumulator, wherein the second accumulator comprises a biodegradable hydraulic fluid, wherein the second accumulator is not configured to supply the biodegradable hydraulic fluid exclusively for use with the solenoid valve, and wherein the valve is operable by a remotely operated vehicle.

15. The blowout preventer system of claim 10, wherein the hydraulically actuatable components of the blowout preventer stack comprise a pair of hydraulically controlled rams.

16. The blowout preventer system of claim 10, wherein the additional components of the lower marine riser package comprise an annular blowout preventer.

17. The blowout preventer system of claim 10, comprising a filtration assembly disposed along the flow path of the hydraulic fluid, wherein the filtration assembly is configured to remove contaminants from the hydraulic fluid.

18. A subsea blowout preventer assembly comprising:

a blowout preventer stack; and a control pod comprising a solenoid valve configured to control a flow of hydraulic fluid to control hydraulic functions of the blowout preventer assembly, wherein the solenoid valve receives the hydraulic fluid from a dedicated accumulator, wherein a reservoir transfer vessel comprises a first chamber configured to receive and store a portion of the hydraulic fluid and a second chamber configured to receive a second fluid to cause the portion of the hydraulic fluid in the first chamber to flow to the accumulator to re-pressurize the accumulator in the event of a pressure loss, and wherein a flow path of the hydraulic fluid flowing between the solenoid valve, the reservoir transfer vessel and the accumulator forms a closed loop.

19. The blowout preventer assembly of claim 18, further comprising a plurality of solenoid valves configured to control the flow of the hydraulic fluid to control hydraulic functions of the blowout preventer assembly, wherein the plurality of solenoid valves receive the hydraulic fluid exclusively from the dedicated accumulator.

20. The blowout preventer assembly of claim 18, further comprising a plurality of dedicated accumulators configured to supply the hydraulic fluid exclusively to the solenoid valve.

* * * * *